US005633985A

United States Patent [19]

Severson et al.

[11] Patent Number: 5,633,985

[45] Date of Patent: May 27, 1997

[54] METHOD OF GENERATING CONTINUOUS NON-LOOPED SOUND EFFECTS

[76] Inventors: Frederick E. Severson, 945 SW Perfecta Ave., Beaverton, Oreg. 97005; Patrick A. Quinn, 20195 SW Imperial Dr., Aloha, Oreg. 97007

[21] Appl. No.: 443,893

[22] Filed: May 31, 1995

Related U.S. Application Data

[60] Division of Ser. No. 160,609, Nov. 30, 1993, which is a continuation-in-part of Ser. No. 588,566, Sep. 26, 1990, Pat. No. 5,267,318.

[51] Int. Cl.[6] ..... G10L 3/00

[52] U.S. Cl. ..... 395/2.76; 395/2.81; 446/297; 84/653

[58] Field of Search ..... 381/51, 52; 395/2, 395/2.76, 2.81, 2.73, 2.77, 600; 84/627, 663, 601, 653; 446/297; 340/384.1

[56] References Cited

U.S. PATENT DOCUMENTS 4,458,110 7/1984 Mozer ..... 395/2.76
4,502,361 3/1985 Viitanen et al. ..... 84/627
4,966,051 10/1990 Tajima ..... 84/663
5,278,943 1/1994 Gasper et al. ..... 395/2
5,400,434 3/1995 Pearson ..... 395/2.76
5,544,354 8/1996 May et al. ..... 395/600

*Primary Examiner*—David D. Knepper
*Attorney, Agent, or Firm*—Marger, Johnson, McCollom & Stolowitz

[57] ABSTRACT

Non-looped continuous sound made up of random sequencing of digital sound segments is generated by taking several short segments of an otherwise continuous sound and forming independent records of those short segments. The stored segments are re-assembled into a sound sequence of arbitrary length based on selecting the next sound segment according to some statistical algorithm. The selected algorithm may be simply a random or pseudo-random selection, or it may provide a probability weighting to emphasize some sound records over others, or some combination of factors also affected by external stimuli such as light, heat or operator input. The selection of sound segments proceeds according to a logical sequence which is programmable. Sounds are organized into groups of similar sounds which may be accessed according to subsects. Groups may include beginning (head), middle and end (tail) sound segments.

3 Claims, 4 Drawing Sheets

METHOD OF GENERATING CONTINUOUS NON-LOOPED SOUND EFFECTS

This is a division of application Ser. No. 08/160,609, filed Nov. 30, 1993 which is a continuation-in-part of U.S. Ser. No. 07/588,566 filed Sep. 26, 1990 now U.S. Pat. No. 5,267,318. The prior application disclosed methods and apparatus for using randomness and motion detection for selecting and playing recorded cow "voices" in a model railroad cattle car.

©Copyright Frederick Severson and Patrick Quinn, 1993: The disclosure of this patent document contains material which is subject to copyright protection. The copyright owners have no objection to facsimile reproduction by anyone of the patent document or the patent disclosure, as is appears in the Patent and Trademark Office patent file or records, but otherwise reserve all copyrights whatsoever.

FIELD OF THE INVENTION

The present application also pertains to the field of electronic sound effects. In particular, this invention describes new ways to generate continuous digital sound from a limited number of stored sound records using random and/or logical selection techniques. This non-looped method keeps the sounds constantly changing in a realistic manner for applications requiring continuous sound effects such as background seashore sounds, cracking fireplace sounds, drums, etc.

BACKGROUND OF THE INVENTION

Creating continuous sounds using looping techniques has been around since tape recorders were available commercially. The idea with a looped sound is to play out a sound record over and over again in a continuous loop to produce a sound of indefinite length from a single short sound record. For instance, the sound of a drum as a background beat can be created by having a single drum-hit sound record played over and over. This is useful in musical synthesizers where a selected drum record can be played out in a loop to provide a constant drum beat to set the timing of the music. This eliminates the need to have a entire drum sequence stored in digital memory or the need for the operator to constantly strike a drum key to maintain the beat.

The problem with any looped sound is that it will get quite boring or irritating when listened to for long periods of time. The mind quickly detects a pattern when the same sound is played over and over and starts to expect or anticipate the next loop segment. The effect is for the mind to either try to tune the sound out or to be distracted by it like listening to the sound of dripping faucet.

Sounds in Nature never precisely repeat. Even when a sound appears to be repetitive, there are always slight differences that tell the listener that the sounds are being created new each time. A drum that is hit consistently, sounds a little different each time and each revolution of a motor that seems to be generating a constant sound, has its own variability. It is this variability that is missing in looped sound that clues the listener in to the fact that it is the same sound record repeated over and over and tells tile listener that it is not a realistic sound effect. Most sounds in Nature or sounds made by man-made machines are not truly periodic. There are slight changes in amplitude and phase that make each "apparent period" slightly different in content. For instance, consider the case of man-made motor sounds of a constant running diesel engine. No matter how smooth a motor is running, it can not run perfectly. There are always slight changes in amplitude or misses or RPM changes that make motors sound like motors. It is the combination of randomness and repetitiveness that gives sounds of machines a "real quality". You know what a motor is going to sound like from second to second—but not quite. You don't know if it will "miss" or speed up slightly or whatever. But what you don't expect is for it to sound perfectly the same.

If we make up motor sounds or horns or any so called "repetitive sound" by looping a short sound record, the sound would be too perfect, too exact and too boring to be believable.

Other continuous sounds that are not considered periodic do even worse when played in a continuous loop. For instance, the sound of children playing could be recorded for some finite time (say 10 seconds) and then played back in a continuous loop to model background playground sounds. However, if there are any distinctive sounds, like a child yelling a phrase or something, the listener will quickly recognize the sound record and the effect will become expected. The sound will have lost its innocent quality and will become irritating. The sound of babbling brooks, wood fires, water falls, traffic sounds, sea shore waves, etc. are all continuous non-repeating sounds that are poorly modeled by a repetitive loop.

SUMMARY OF THE INVENTION

Non-looped Continuous Sound by Random Sequencing of Digital Sound Records can be abbreviated in name to Random Sequenced Sound, and further abbreviated as RSS. RSS, at its core, consists of taking several short segments of an otherwise continuous sound, and making independent records of each of these short segments. Then these independent segments are re-assembled into a continuous, never-repeating sound sequence based on selecting the next sound segment according to some statistical algorithm. This statistical algorithm itself may be chosen by various circumstances (such as the passage of time, or the coincidence with some other sound effect, changes in ambient light, heat, operator input of some sort, etc.) or perhaps selected from a library of algorithms in a deterministic or random way. Also, there are RSS situations where you will want to switch from one set of sound segments to an alternate set of sound segments. Examples might be birds in the morning and crickets at night. Or, perhaps, crickets until a model train comes by and then barking and howling dogs. There may or may not be specific silent pauses inserted between each record, depending on the desired effect. Also, the sound segments may be sequenced in a logical but statistical way depending on the content of the previous sound record or other inputs to the system.

Random sequenced sound is a way to produce continuous sounds that follow a theme and vary in content by logical and/or statistical methods in order to model the continuity, variability, and logical progression of sounds heard in real life. It is not simply a method to play different sound records in a random way such as might be produced from a CD machine playing different songs in a random order.

Accordingly, one aspect of the invention is a method of generating random sequenced sound. In general, the method includes the steps of storing a sound record; dividing the sound record into a plurality of sound segments; providing a desired probability density function "pdf"; selecting one of the sound segments according to the probability density function; playing the selected sound segment; and repeating said selecting and playing steps thereby generating non-looped continuous sound.

The probability density function pdf can take many forms. For example, it may provide a uniform distribution so that each of the sound segments is equally likely to be selected and played at any time. In another embodiment, the probability density function may provide an approximately Gaussian distribution so that certain sound segments are more likely to be selected and played than the other sound segments. Any desired "weighting" of the sound segments can be implemented by the pdf.

"Logical Sequenced Sound" (LSS) features selection of sound segments not merely in random sequence, but in a logical sequence whereby each selection depends on one or more selections that preceded it. Alternatively, LSS may be used for selecting an appropriate group of sound segments, while the selection and playing of individual segments within the group proceeds according to a predetermined function such as a pseudo-random selection.

This invention describes methods to produce continuous sounds that do not have a recognizable pattern which, in turn, keeps the sounds fresh and non-predicable and reduces the irritation common with looped sound effects. This invention has application in many areas. Some of these are listed below:

background sound effects for model layouts such as model railroading
soothing, restful, or interesting background sound for homes or businesses
producing sustained sound such as the middle portion of a digitally produced horn
in music synthesizer rhythm generation
sound effects to deter burglary
sound animated selling displays
pest repelling applications (e.g. mosquitoes, moles, deer, etc.)
sound pacifier to soothe a crying baby
sound animated "artificial window" (a wall hanging that simulates a window)
motor sound simulator for kids' bicycles
animal attractors (e.g. sound animated duck and elk decoys)
sound generation for games
motor sound effect to modify or enhance a car's natural motor sound
sound animation for dolls and stuffed animals
Sound Bloxx (a product by QSIndustries, Inc.)
Live Action Sound Unit (a product by QSIndustries, Inc.)
sound animation added to Random Sequence Animation—(e.g. LCD computer graphic animation)

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
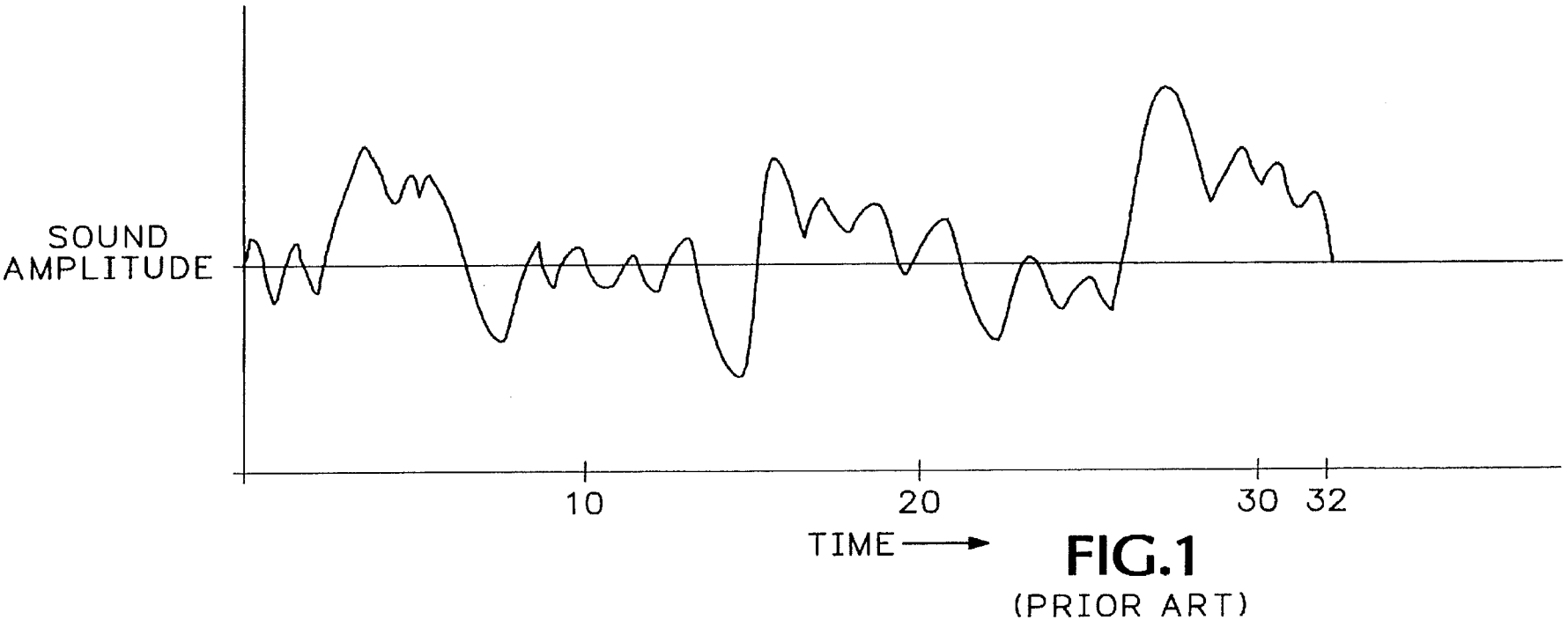
FIG.1 (PRIOR ART)
FIG. 1 illustrates a sound amplitude waveform versus time.

What is Random?:

The word "random" is used a lot in both casual as well as technical conversation. In casual conversation, random generally means unpredictable. In technical conversation, "random" is used to mean "equally likely"—but may generally refer to some mathematical process whose values are determined by a probability density function (pdf). This pdf is a mathematical description of likelihood of certain values occurring. It is basically, a "likelihood" weighting function. With regard to RSS, the independent sound segments are not numbers from a mathematical equation. Each sound segment will be assigned a number for reference. When a particular type of pdf is desired (such as Gaussian, or Uniform, etc.) then numbers according to this pdf will be generated and used as pointers to select a given sound segment. In this way, the RSS effect will have some particular probability distribution of the sample segments.

In the real world, so-called random effects never repeat. When digital computers are used to produce random effects, the word pseudo-random is generally used. This is because the computer uses a seed value to generate numbers from a mathematical algorithm. While generated pseudo-random numbers, for most practical purposes, can be considered "non-repeating", they will eventually repeat. With a well-designed pseudo-random generation process, the period of this repeat will be made to be so large that relative to the application, the period will seem infinite. For example, a pseudo-random process for RSS might repeat once every several thousand—to once every several millions of events (where an event refers to the selection of one of several sound segments as the "next" one to use). It is important to keep from restarting the pseudo-random process with the same seed each time the power is applied. If the pseudo-random process is restarted each time the power is applied then the very long count pseudo-random process will be no better than the length of time the power was left on. Then the pseudo-random process will do the exact same thing next time the power was turned on. To get the entire very long count pseudo-random process, we propose using non-volatile memory to store the value of the seed that was used last time the process was powered up. Then by incrementing or otherwise overwriting the previous seed value in an intelligent way, or by storing where in the pseudo-random sequence you last were, the full length of the pseudo-random sequence can be experienced. The point is, that pseudo-random sequences will clearly qualify as generators for random, unpredictable, never-repeating pointers for RSS.

If a 600-second record were used over and over (by looping) for producing a continuous sound effect, you would get a record that, for some sound effect applications, may seem long enough that the listener might get somewhat lost as to where in the record he was, but sooner or later the listener would begin to recognize the loop. An additional problem is that the storage for large sound records becomes very expensive, and sound processing IC's typically will not readily play more than about 30 seconds of sound. For sound sequences of, say, only 30 seconds, the looping effect is very pronounced and undesirable. What is needed is a way to get a really good continuous sound effect when all you have available is some limited amount of sound record storage time.

Figure 2:
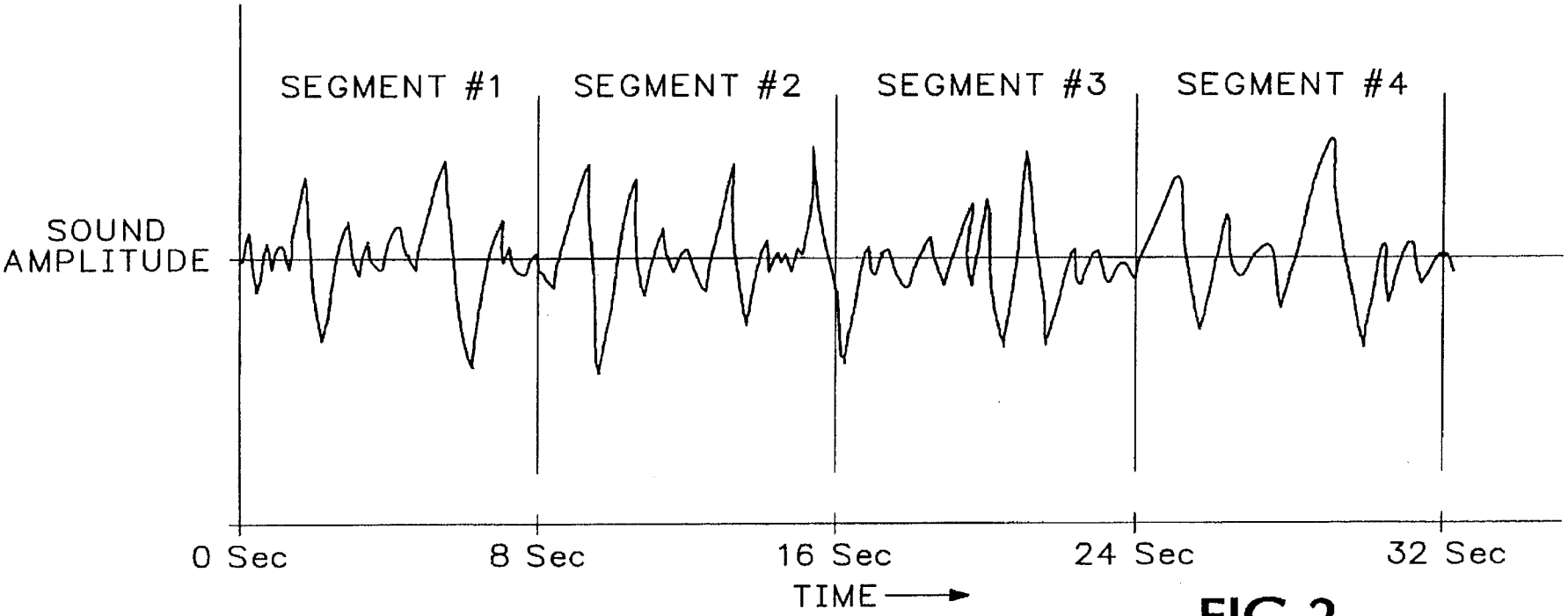
FIG. 2 illustrates a sound amplitude waveform divided into multiple segments.

FIG. 1 shows a 32-second segment of a continuous sound. Let's say it is the sound of the crowds at a baseball game. One approach to making a continuous baseball sound effect is to simply loop the 32-second record. This has the previously-mentioned problem of becoming annoying after listening to a number of repetitions. The first RSS method that might be employed is to simply break the 32-second record into a number (say 4) of equal (in this case, 8 second) segments. As shown in FIG. 2, we might label these segments 1 through 4 in sequence. One of the effects that we can produce with RSS is the classical "looped sound" effect. This is done by using simple modulo-4 counting as the selection algorithm. Thus the segments would be played back as: {1,2,3,4,1,2,3,4,1,2,3,4,1,2,3,4 . . . etc.}. Thus, RSS is capable of playing the sound segments in such a way as to produce classical "looped sound".

Next, we might chose tile next segment to be played from a Uniform distribution. Such a distribution would, on average, have an equal number or 1's, 2's 3's and 4's in a long sequence. An example of this might be played as: {1,3,2,4, 2,2,2,4,1,3,4,4,1,3,1,1,4,2,3,2,1,3,3,4, . . . etc.}. Notice that sometimes there are immediate repeats of the same segment. At times, a given segment might not appear for quite some time. This is simply the nature or a random process—unpredictability, except in terms of averages.

Weighted Selections

Another interesting RSS method is choosing the segments from a Weighted Uniform distribution. For example we might weight 1 as 70% and 2,3, and 4 as 10% each. Thus this type of distribution might play as: {1,4,1,1,3,1,1,2,2,1,1,1, 1,1,1,1,1,1,3,1,4,1,1,1,1,1, . . . etc.}. Thus, #1 would play seven times more often than any of the others—but, you would still have a completely unpredictable, continuous sound effect.

Number of Segments

The possible selection algorithms are by no means limited to the ones described here. Any stochastic weighting or mathematical formula may be used as a pdf. The goal is to produce a continuous sound effect that has designed average aspects, while maintaining specific unpredictability. In practice, with a limited total sound storage time, the RSS effect improves as the number of segments increases—up to a point. That point is where the segments become so short that they are incoherent and not recognizable. For many effects, we have discovered that 16 segments is a very practical number for about 32 seconds of sound.

Unequal Length Segments

In the cases described above, the segments were of equal length. In practice, this does not work very well. That is because there are natural ebbs and flows in many sound records which should be kept together. For example wind gusts in a "storm" background sound effect should not be broken up in the middle of a gust. Thus, in practice, the total sound record is often divided up into several segments that will likely be of different lengths.

Avoiding "Ringers"

There are certain sounds that are sufficiently distinctive that they are recognized very clearly. That is, they attract your attention very strongly. These type of sounds are called "ringers". They are easily identified as unforgettable. The best RSS results will be obtained if ringers are eliminated frown any of the records. Ringers become inordinately annoying when the random sequencer just happens to produce a series of repeats of the same ringer.

Beginning/Ending Compatibility

It is crucial to ensure that the beginnings and endings of every segment (in a given group of segments to be played sequentially) have endings that are compatible not only with their own beginning, but with the beginning of any of the other segments. Such compatibility means that the segments must be interchangeable without noticing the seams. It generally means that you cannot begin or end in the middle of some dramatic sound. For instance, groups of records that are filled with "tonal" effects such as the howling of wind, must have the frequency and intensity of the howling matched. Further particulars of compatibility include making certain there are no overall frequency or amplitude shifts between the beginning and end of any segment and to ensure that the sample values and wave-form slopes align properly. Our experience is that it is generally best to make segment boundaries at or near high-slope zero crossings. In the case of very tonal segments such as horns or whistles, it is very important to select a segment boundary that is at the same periodic boundary of the slowest sound in the segment.

Segment-Ending Compatibility For Horn Effects

In the case where RSS is used to make a digital horn effect, there is an additional concern. A digital horn (or whistle) effect consists of a HEAD segment which contains the opening sound of the horn, a MIDDLE section which will consist of one or more segments to be played as a sustained RSS sound, and a TAIL segment that contains the closing sound of the horn. The HEAD flows into the "first" selected segment of the RSS MIDDLE. Thus, compatibility must be assured between the end of the HEAD and the beginning of the first MIDDLE segment. As the MIDDLE section is played out, the various segments will be RSS-shuffle played so long as an operator is requesting the horn be played. When the horn is no longer requested, whatever segment you were last playing will then need to be successfully spliced to the beginning of the TAIL segment. In other words, all middle segments of the horn sound need to have the beginning and end of each middle segment properly connect to the end and beginning of any other middle segment plus the additional requirement that the beginning of each middle segment must properly connect to the end of the HEAD segment and the end of each middle segment must properly connect to the beginning of the TAIL segment. Also, the end of the HEAD segment must properly connect to the TAIL segment. The last condition occurs for very short horn blasts where there is no middle segment played at all; that is, as soon as the HEAD segment is finished, the TAIL segment starts.

There is another advantage in having the MIDDLE section made up of smaller sub-segments. If the operator wants to have short horn blast, the short sub-segments allow total horn sound length (HEAD+MIDDLE+TAIL) to have finer resolution than if the middle segment were not divided. For instance, if the HEAD section is 1 second long, the MIDDLE section is 8 seconds long and the TAIL section 3 seconds long, the shortest horn blast is 4 seconds (HEAD+TAIL) and the next shortest is 12 seconds. However, if the horn MIDDLE section is divided into 4 segments of 2 seconds each, than the choices of short horn blasts are 4, 6, 8, 10, or 12 seconds. Clearly, the operator has gained more control and choice over the operation of short horn sounds. If this is combined with RSS, then the short horn blasts can have different sounds each time the operator requests the horn effect.

Also, this technique of segmenting the MIDDLE section has an advantage with longer horn blasts since the horn appears more responsive when the operator wants to end the horn sound. Normally, when the operator stops his request to play the horn, the MIDDLE section that is currently playing will play to its end and join with the END segment. If the MIDDLE section is not divided, the operator may have to wait for the entire MIDDLE section to end before the END section begins. In the above example, the horn could continue to play for a maximum of 11 more seconds or a minimum of 3 seconds, depending on where in the MIDDLE segment you were when the operator wanted to end the horn sound. Performance like this would be confusing and appear very non-responsive to the operator.

While the idea of making a digital horn effect by splicing together a HEAD segment to a looped MIDDLE segment and splicing that to a TAIL segment is prior art, it is a novel idea to divide the MIDDLE section into several short "sub" segments—even when the segments are played in a fixed order (a standard loop)—so that there is very low time delay between the "end horn" request and the end of the sound.

Note that although the middle section represents the sustained or steady-state part of the horn, each sub-segment can be slightly different to provide variability in the horn sound. If the middle section is actually made up from a real horn recording and then divided into sub-segments to use for RSS applications, these sub-segments will likely have the required variability since real horn sounds, even in steady-state are constantly shifting slightly in pitch, volume, etc.

Adding Special Segment Effects

The depth of realism of an overall RSS effect can now be greatly enhanced by over dubbing special effects on the background segments. Examples of these special effects are easily demonstrated by describing the sounds of a "baseball game" effect. Here the background sounds are the general ambiance associated with a large stadium filled with fans. These might include general crowd sounds, wind, etc. Added to this background could be over-dubbed sounds such as the sound of pitches being hurled, the crack of a bat, vendors hawking food and souvenirs, fans yelling at the umpire, etc. It is vital to remember the importance of avoiding ringers with the special effects though. For instance, the words spoken by vendors or fans should be vague or full of reverb or muffled or inarticulate—just, not a finger. When done properly, the overall effect of RSS with special effects is impressive.

Two (or more) RSS Machines To Produce A Combined Effect

It is possible to use two completely independent RSS machines to produce an overall sound effect that has better depth and unpredictability than can be had from a single unit. The drawback (in some cases) is that unless the two units are accepting control signals from one another, there will not be any explicit synchronization of the sound effects from the two (or more) units. In other cases, not having any unit-to-unit synchronization is exactly what is desired, as it will produce a much greater level of perceived unpredictability. A good example of this would be the combining of a RSS "Stormy Night" effect (with distant church bell, thunder, squeaking gate, barking dog, etc.) with a second RSS unit producing "Haunted" sound effects (with a moaning ghost, crazy laugh, howling wolf, flapping bat, etc.) to produce an amazingly realistic "Haunted House on a Stormy Night" effect.

Logical Sequenced Sound (LSS)

The RSS effects described so far have all been produced from pre-recorded fixed sound segments. The next type of method to produce even greater levels of depth and realism in producing continuous sound effects is to create the RSS sound segments "on-the-fly" logically from a finite library of sound fragments through overlay dubbing and sequencing with a microprocessor or Digital Signal Processing (DSP) integrated circuit. This type of effect might be described using a "Cow Feedlot" effect as an example. The way LSS works is that the computer will have a library of cow moos, such as (long low moo), (short low moo) (long high moo), (short high moo), (gasping moo), (upward inflected moo), (downward inflected moo), (stuttering moo), (curious moo), etc. Also, in the library might be a selection of stomping and eating sounds and a selection of background sounds (i.e. kid yelling, dog barking, water trough filling, chewing and munching, etc.) Now, the computer has algorithms (mathematical plans) of how to put together endless variations of sound segments based on probable logical responses. For instance, if a dog-barking record is played, it increases the likelihood of another dog-barking record or more sound from cows. If kids are yelling, there is a greater chance of more kids yelling or if the last record played is the sound of kids leaving, then the likelihood of another kid record is reduced. If a record is played that is the sound of a trough filling with water, then the computer likely may next produce a chorus of 3–5 selected cows followed by a couple of single cows with overlaid kicking and stomping. In other words, each sound segment or combined group of sound segments is weighted by its logical likelihood of occurrence based on the previous sound records. Each segment will be built sequentially from a set of statistical rules which would produce an interesting and never-repeating Cow Feedlot effect. In some cases what occurs is that the selection of sounds to be over-dubbed, or the equalization or special effect given one or more over-dubbed parts will be modified—based on what sounds have been previously played. Very complex patterns of sounds can be produced that have a casual history based on previous records and other inputs that evolve in time in a logical and probably but unpredictable manner.

For instance, another good example of LSS would be to return to the sounds of a baseball game. A sound record, chosen by the computer, announces a player up to bat that has a good batting record. This makes it likely but not guaranteed that the next record will be the sound of the bat hitting the ball which will make it likely that the fans will cheer loudly. On the other hand, it is possible but less likely that this good batter would strike out and the fans would react accordingly. The announced scores would, of course, be based on the actual outcome. If the batter hit a home run, the score would increase for his team and be announced by the appropriate sound record. The point is, that the baseball game sounds would proceed logically but not predictably, but nonetheless likely-just like real life which seems to plod along in an orderly manner but with its real surprises from time to time.

It is worth noting that it is possible to get even more depth and realism from your limited sound storage memory by producing the sounds themselves as made up from segments of HEAD+MIDDLE+TAIL similar to the digital horn techniques described earlier. To the extent possible, the greatest variation will be obtained by constructing as many of the sound fragments (like a moo or a stomp or a bark) from sub-fragments consisting of a HEAD+MIDDLE+TAIL methodology. In this way, even memorable "ringers" can happen and may never repeat again because they are made of a number of independent sub-fragments that will likely never sequence in the exact same way. In theory, it is possible to endlessly extend the variation of possible sounds by creating and over-dubbing many sound segments made using the above-mentioned HEAD+MIDDLE+TAIL methodology.

Event-Responsive RSS or LSS

To further increase the depth and realism of continuous sound animation it is possible to have one or more aspects of the sound generation and sequencing be responsive to various events or inputs. Examples of events to which responsiveness might be appropriate are the passage of time, or the coincidence with some other sound effect, changes in ambient light, heat, operator input of some sort (pressing a button, saying something, passing nearby, snoring, etc.), the appearance of an object or animal, a control signal received from another RSS/LSS sound unit, being moved, jerked or giggled, turned over, being touched, presence of an odor, etc. The idea here is that some aspect of the sound generation changes (such as the frequency of use of a sound segment, the length of created LSS segments, the statistical weighting of various sounds or sound fragments, the loudness of selected sounds or overall loudness, the pitch of selected or overall sounds, the equalization or reverb of selected or overall sounds, which library of sound fragments or which set of segments, the selection, equalization or sound treatment of over-dubbed sounds that are created on-the-fly, etc.) in response to the event or input.

Application to Moving Images:

The concepts of RSS and LSS can be extended to moving pictures although it may be more difficult to connect one visual scene to another in a seamless manner than it is with sound. For instance, sound segments of a windstorm can be easily connected together to produce a continuous sound effect but the visual segments of tall grass blowing in a windstorm may not as easily be connected without an obvious transition between segments. Nevertheless, there are many applications where simple visual images can be connected in a random sequenced or logical sequenced manner and many of the concepts described for sound can be applied to moving pictures as well.

Description of Selected Applications:

Many of the applications listed in the Field of the Invention represent, at a minimum, a new product or process based on the inclusion of the use of RSS and/or LSS and should have a more complete description in this patent.

Music Rhythm Synthesis

Music rhythm synthesis is a very popular topic and has much commercial development behind it. The prior art in this area consists of breaking a song into six parts and producing a fixed rhythm for each of those six parts. These parts are often referred to as Introduction, Transition to Verse, Verse, Transition to Bridge, Bridge, and Ending. Two of these parts are continuous sounds. They are the Verse and the Bridge. The others are finite parts and, as such, have less (but finite) relevance to this patent. Prior art describes Verse or Bridge sections (with or without accompaniment) as lasting a fixed number of measures (typically 8) and then repeating. This technique produces the rhythm synthesis track which is famous for its mechanical and boring repetitiveness. One synthesizer design goes as far as to produce individual rhythm notes that can be assigned a "random nature". But no synthesizer utilizes anything like RSS.

In this field, we would use RSS in the following way: the Verse (or Bridge) would still consist of a fixed number of measures (typically 8) and would continue to consist of rhythm (and perhaps accompaniment) notes that may or may not themselves have a random aspect to the specific note (such as volume, pitch or timbre), but what would be added is that each of these (say 8) measures would have several (say 4, as in A, B, C, and D) variations. Each of these 4 variations would be equally valid to use at its particular measure. The RSS rhythm generator would statistically chose one of the variations at each of the measure locations, and seamlessly produce endless interesting variations of the basic 8-measure Verse structure. A typical RSS Verse might play as:

{1A,2D,3D,4B,5C,6D,7A,8B‖1B,2C,3B,4A,5D,6C,7C,8B‖1D,2A,3A,4B,5D,6B,7A,8C‖ . . . etc.}. The sequence shown here represents what would have been 3 boring repeats of exactly the same Verse loop, namely:

{1A,2A,3A,4A,5A,6A,7A,8A‖1A,2A,3A,4A,5A,6A,7A,8A‖1A,2A,3A,4A,5A,6A,7A,8A‖ . . . etc.}. But, because the synthesizer has RSS ability, the Verse becomes unpredictable and endlessly interesting. This technology represents a great advancement in realism for music synthesizers. While the other parts of the song are not typically repeated over and over, they too would benefit from the use of RSS to reduce any trace of "mechanical drumming" that would arise from these other song parts being identical every time they are played. The use of RSS in synthesizers would require the use of larger amounts of memory, but the results would be well worth it.

Burglary Deterrent

One approach to deterring house burglaries is to make a sufficiently convincing appearance that someone is home and up, that a burglar decides to go somewhere safer. Sound effects that are produced using looped sound will be too repetitive and predicable. A would-be burglar will quickly be able to determine that this is not the real thing. A burglary-deterrent sound effect produced by RSS on the other hand would be very difficult to determine that it is not a live person or dog. The Burglary-deterrent sound effect might be placed in a bathroom. The program might consist of turning on a light in the bathroom, followed by RSS sound of running water, next RSS coughing, next RSS urine splashing in toilet bowl, next a toilet flush, next a RSS toilet tank filling sound effect, next some RSS dog barking, next some RSS dog scratching at door, next some RSS sneezing, next bathroom light on then off, etc. This application is, of course, a very good candidate for LSS techniques as well. Some visual imagery could also be added to the burglary deterrent such as appropriate shadows cast on bathroom windows, etc. that would make it even more convincing that someone is at home.

Sound-Animated Window Box

This application consists of an enlarged photograph of a beautiful scene, such as a park, which is mounted inside a special frame. This frame looks like a window, complete with curtains. The window comes with RSS/LSS sound animation to enhance the illusion of this being a real window to the outdoors. The RSS/LSS sound system incorporated in this application would likely contain mourning doves, singing birds and the like during the daytime hours and change to frogs and crickets and the like at night. Thus, a person with an office that has no window would be able to create the effect of a real window scene, complete with realistic continuous, non-repetitive sound effects. Lighting inside the frame could be a combination of fluorescent and incandescent lighting with each on dimmer circuits that will adjust the intensity depending on the time of day. Thus, dawn and dusk times would have a warmer glow from incandescent lights. Midday would have the blue/white color intensity of outdoor-color fluorescent lights. Eventually, random sequenced and logical sequenced visual images could also be added to the window scene to produce even more pleasant and realistic effects.

Electronic Automobile-Motor-Sound Enhancement

Figure 3:
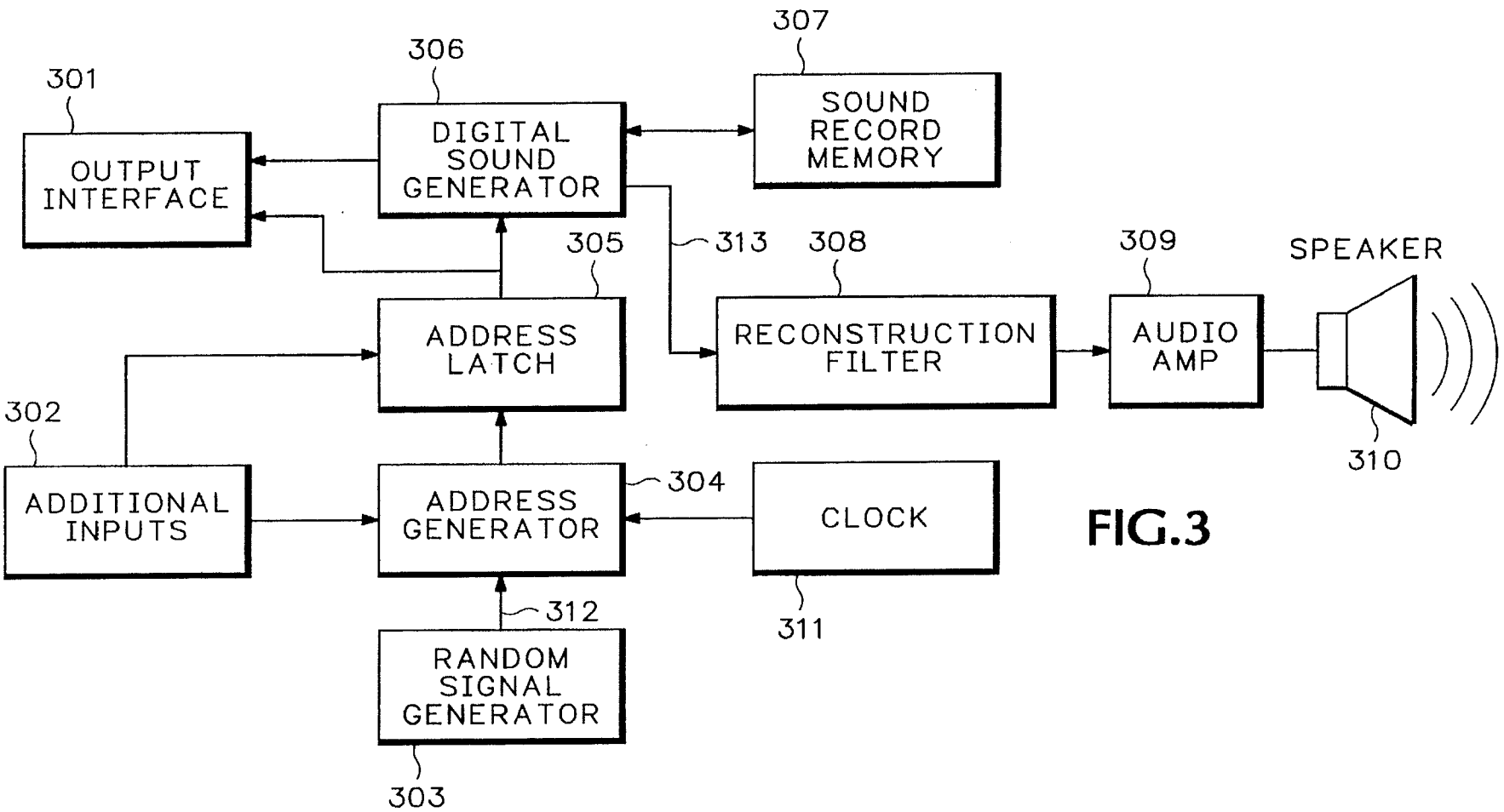
FIG. 3 is a functional block diagram of an electronic system for generating random sequenced sound effects.

Many people, especially young men, wish their car (typically a VW bug or perhaps a Yugo) had the exciting motor sounds of a Porsche or perhaps Lambourgini. This is the "grown-up" version of inserting a playing card into the spokes of a bicycle to make it sound like a motorcycle. In this grown-up version, the motor sound would be produced using RSS to create a motor sound that had enough realism to be truly believable. Thus, this electronic motor sound would have subtle variations in the sound including missing firing cycles, minor speed fluctuations, slight variations because of mechanical motor load, etc. The RSS machine producing this effect needs an input from the motor to determine the RPM of the actual engine. While the RPM of the electronic motor sound effect will scale up and down with actual motor RPM, it will, at every speed, be constructed using RSS rather than classical looping techniques. An additional input from the car's vacuum advance system might be used to modify the sound effect based on actual motor loading. The electronic motor sound could then be transmitted on a very low-level short-range (like 4 ft.) FM radio signal that would be picked up by the FM radio inside the passenger compartment of the car. Thus, the electronic motor will be played through the car stereo, providing potentially thunderous and very exciting motor sound effects. This same concept can readily be applied to a bicycle, using wheel speed detection instead of engine RPM detection, to produce responsive sound effects of a powerful motorcycle Illustrative Implementation In general, what is needed to embody RSS is sound generation means coupled to a selection randomizer. A block diagram of such an embodiment is shown in FIG. 3. Referring to FIG. 3, an Address Generator, 304, is a counter that generates a series of address bits in a continuous manner by dividing down the timing signal from Clock 311. Random Signal Generator, 303, produces a signal at output line, 312, that is random or pseudo-random in time with respect to the timing of Clock, 311. The signal on line, 312, stops the generation of random addresses and presents the current address to the Address Latch, 305, which in turn sends a request to play the sound record at this address to the Digital Sound Generator, 306. When the Digital Sound Generator, 306, is finished with playing out the present sound record, it will accept the new address, and request from Sound Memory, 307, the sound record at the address in Address Latch, 305. The digital sound record is converted by an internal A/D circuit to an analog output, 313, and sent to Reconstruction Filter, 308, to produce a suitable analog sound signal for the Audio Amplifier, 309, and Speaker, 310. Additional Inputs, 302, can provide an external random signal that replaces the random signal from the Random Signal Generator, 303, and can also present address signals directly to the Address Latch, 305, and override address from the Address Generator, 304. The Digital Sound Generator can also send the analog sound signal to Output Interface, 301, for external amplification and sound reproduction. The address from Address Latch, 305, can also send the current requested address to output interface, 301, to direct other activities to correspond to the next sound record to be played.

The Sound Record Memory, 307, contains from 1 to 16 different sound records depending on the application. With only one record, there is no RSS operation; the purpose is to just play out a single sound record. However, the amount of delay time between each playing can be made random and with an average value that can be controlled by the clock rate from Clock, 311, and the clock rate from the Random Signal Generator, 303. If there is more than 1 sound record in the memory, 307, then this embodiment will play a continuous series of sound records that will be randomly sequenced.

If there are 16 or so sound record memory locations but only a few actual sound records are required, then simple probability distributions can be produced by duplicating the same sound record in these different memory locations. For instance, if there are only two sound records (record #1 and record #2), then eight duplicates can be stored of each different sound record which means that it will be equally likely that either sound record will be played. However, if four duplicates of record #1 are stored and twelve duplicates of record #2 are stored, then, on the average, record #2 will play three times more often. Using this technique, simple weightings of sound records can be achieved within the limits of the number of memory locations available.

In this embodiment, the random signal source is a timing signal from the Random Signal Generator, 303, based on an internal clock that has an imprecise period with respect to the faster clock signal from Clock, 311. In this respect, the random addresses from the Address Generator, 304, are based on a true random phenomena since the statistical difference between two clock periods is based on noise generated in the electrical circuitry. Other naturally occurring and available noise sources that can be used in similar circuits are shot noise in transistors, or noise in back-biased zener junctions.

The above method of doing RSS is quite inexpensive and suitable for simple RSS applications. However, in order to employ the potential of the ideas behind RSS and LSS, a computer based implementation is preferred.

Figure 4:
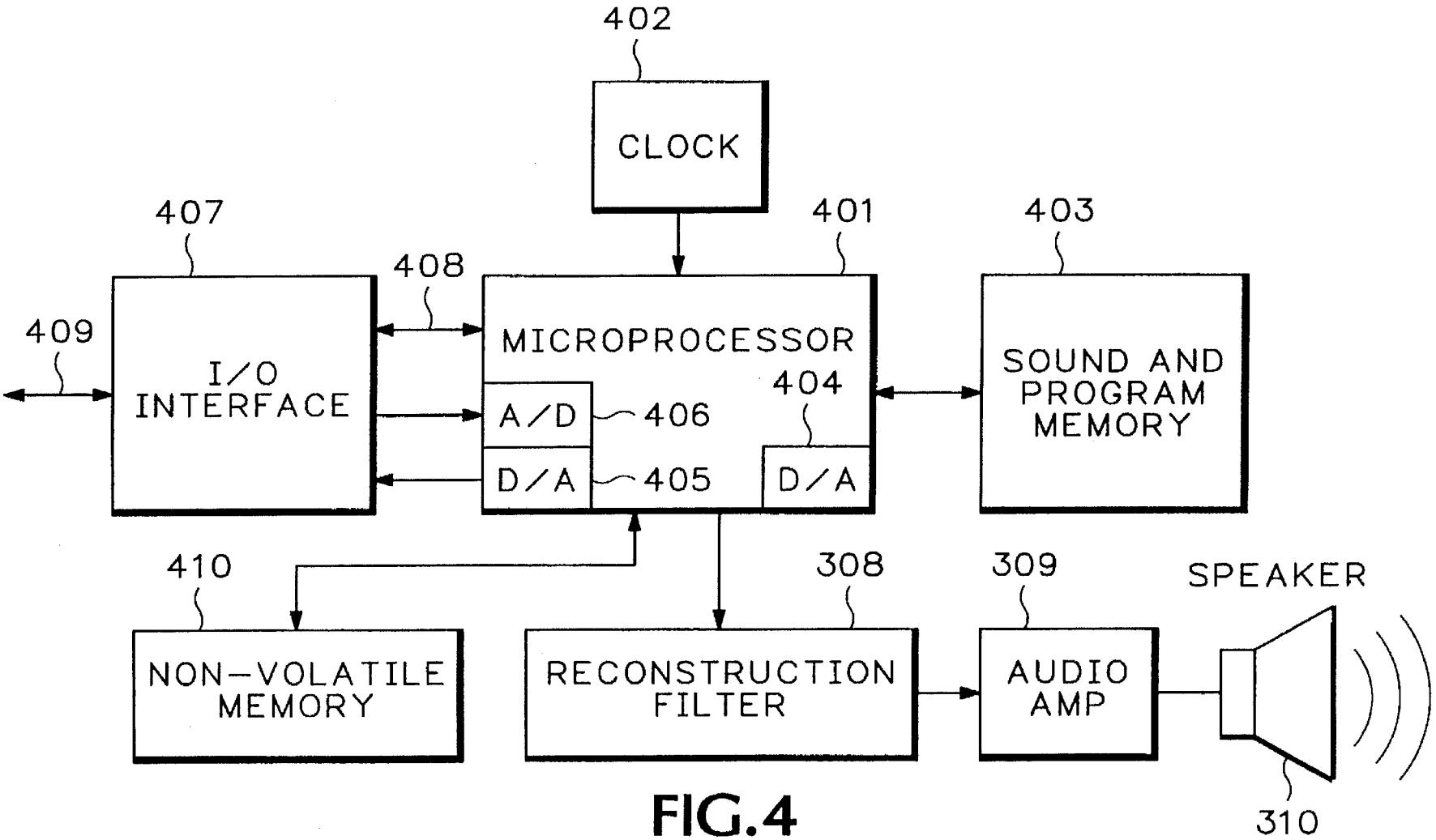
FIG. 4 is a functional block diagram of an electronic microprocessor-controlled system for generating random sequenced sound and logical sequenced sound effects.

Description of a Second Embodiment:

The block diagram in FIG. 4 shows an embodiment using a Microprocessor, 401, to perform many of the functions described above plus many other capabilities including LSS. This embodiment consists of the Microprocessor, 401, connected to the memory, 403 and processor Clock, 402. The Reconstruction Filter, 308, Audio Amp, 309 and Speaker, 310, serve the same functions as they did in FIG. 3. The digital to analog converter, 404, shown here as embedded in the microprocessor architecture, is used to produce the analog sound that is sent to the Reconstruction Filter, 308. The Microprocessor, 401 is also shown connected to Interface block, 407, through internal D/A, 405, A/D, 406, and digital bus, 408. The output connections to Interface block, 407, to external apparatus, is shown via lines, 409.

Also connected to Microprocessor, 401, is Non-Volatile Memory, 410. The purpose of this memory is to hold variables which need to survive the power being turned off. Examples of such variables are previously-described seed values or position pointers for pseudo random number generation, user-defined volume or tone settings, other user preferences, program status at power-down, etc.

The purpose of the Interface block is to connect signals from external inputs, 409, like other Microprocessors or sensors for light, temperature, heat, proximity of objects, etc. to affect the operation of the program in the Microprocessor, 401 and for the Microprocessor, 401, to affect other microprocessors or other apparatus such as lights, animation machines, switches to control the outside environment, etc. The A/D converter, 406, allows external analog signals to be applied directly to the Microprocessor, 401, for analog control of its behavior.

In this embodiment, the Memory, 403, not only contains the sound records but the programming for the Microprocessor that performs the functions of random number generation (or, in this case, probably pseudo-random number generation), sound record selection based on suitable probability density functions and logical weighting functions and the overall "story line" that defines the theme and general direction of scenarios to be played out (e.g. baseball game to be played from start to finish). In this embodiment, a software language would be developed that would allow for easy definitions of instructions for the RSS and LSS programs. For instance, in the programming language, there may be a line of code that begins the whole operation by starting the first sound record such as:

001 PlayRecord (4,17, WhenFirstPoweredUp)

where "PlayRecord" is a command to start a sound record and the argument, 4,17, indicates that the seventeenth sound record from sound record group, 4, and "WhenFirstPoweredUp" indicates that this record starts when power is applied. The beginning "001" is the line code for the program. The next line of code may be something like:

002 PlayRecord (Random3, 12)

where "Random3" indicates the kind of probability function (1. Gaussian, 2. chi-squared or 3. uniform, etc.) that is to be used on group 12 recordings. In other words, if Random3 means "uniform", then it would be equally likely that any of the records would be picked.

Note that each distribution would also have a set of arguments to define its characteristics. For instance, a Gaussian distribution would be defined by its mean and standard deviation. Hence, to be complete, "Random" would be written as "Random 1(m,s)" where "m" is the desired mean and "s" is the desired standard deviation. Also, m or s may be specified as preset values or they may be computed or selected based on the present state of the program.

If you wanted the program to continue with RSS from sound group 12, the next line of code may be 003 GoTo 002.

Instead, perhaps a LSS command is given such as:

003 If(12,3 GoTo 5)

004 GoTo 002

005 PlayRecord (Random1(15,2,6)

006 GoTo 002

If record three from group twelve happened to be played, the computer is instructed to go to program line 5 where it will play out a random record frown sound group 6 using a Gaussian distribution and then return to line 002 to start another sound record from group 12. For instance, let's say that record 3 from group 12 is sound of a ball being hit hard frown the bat, a sound that may draw a strong reaction from the crowd.

Let's say that group 6 has 20 different sound records of excited crowd sounds that range from disappointment to wild cheering where the #1 sound record is complete disappointment and the #20 sound record is wide happy cheering. Hence, we are requesting an average which biases this sound set toward wild and happy cheering with a small standard deviation (2). That means that most of the time the crowd will like the results of record #3 of sound set #12.

Note that the arguments of the distributions, themselves, can be variables or functions or other variables. A well specified LSS programming language would allow all important parameters to be modified by the program. For instance, Random1(m,s) might be written as Random1{m=10+3*(temperature-68),2} where now m changes by the programmed-simulated temperature on the playing field. This would allow the crowd to become more excitable and more prone to happy cheering as the temperature increased.

Hence, this is an example of LSS where the listener would hear a dramatic crowd reaction to the ball being hit hard that would be logical but not predictable. An obvious extension is to write another line of code that would direct the computer to make another choice based on which crowd reaction sound record was played (such as cheering or disappointment). If it was disappointment, then the choices may be a foul ball or a fly ball that was caught, etc. You can see that this baseball game could take any number of logical paths but none are completely predicable. The simple programming language here looks FORTRAN-like but the actual language may be much different such as object oriented programming, etc. The point is, that the computer-based system provides many more possibilities to express the potential that is inherent in the RSS and LSS concepts.

Summary of New Concepts:

1. The concept of randomly sequencing a set of sounds to produce a never-repeating continuous sound effect.
2. The concept of choosing the sequencing from one of several possible statistical algorithms.
3. The concept of selecting the statistical algorithm based on various circumstances.
4. The concept of changing to an alternate set of sound segments.
5. The concept of choosing the segments to be sequenced, by logical but statistical means, according to a theme.
6. The concept of saving information about a computer's pseudo-random generation process in non-volatile memory as to create full-length random number generation over the life time of a product.
7. The concept of dividing an otherwise continuous sound into a number of segments and playing them back in random order.
8. The concept of using statistically weighting to choose the play order for sequencing sound segments in RSS.
9. The concept of using segments of unequal length as to keep natural sound groupings together.
10. The concept of avoiding "ringers" when producing RSS effects.
11. The concept of ensuring beginning/ending compatibility of RSS segments.
12. The concept of making the MIDDLE section of a "looped horn effect" by RSS.
13. The concept of ensuring the compatibility between the end of each MIDDLE sub-segment in a "looped horn effect" by RSS with the beginning of the TAIL segment in a "looped horn effect" by RSS.
14. The concept of using a segmented MIDDLE section of a "looped horn effect" to improve the resolution of available horn length options.
15. The concept of overdubbing "highlight" effects onto "background" RSS segments.
16. The concept of using two or more RSS machines to produce a sound effect with greater unpredictability than a single RSS machine.
17. The concept of choosing or modifying RSS segments based on a logical but statistical theme as to produce an unpredictable but likely chain of sound events.
18. The concept of producing RSS segments themselves as made up of HEAD+MIDDLE+TAIL methodology.
19. The concept of producing RSS segment effects of great variety and of various duration by combining RSS techniques for the MIDDLE section of a HEAD+MIDDLE+TAIL sound segment.
20. The concept of producing an animated sound program using RSS/LSS technology that consists of constructing entire events such as baseball games, football games, and the like.
21. The concept of changing some aspect of an RSS sound segment based on responsiveness to another event.
22. The concept of applying RSS/LSS to moving images.
23. The concept of applying RSS to music synthesis rhythm generation.
24. The concept of applying RSS/LSS to burglar deterrent products.

25. The concept of applying RSS/LSS to a sound-animated window-box product.
26. The concept of applying RSS to electronic automobile-motor-sound enhancement products.
27. The concept of applying RSS to electronic bicycle motorcycle-motor-sound enhancement products.
28. A specific electronic embodiment of an RSS product using stand-alone random-segment address generation.
29. A specific electronic embodiment of an RSS/LSS product using a microprocessor-based design.
30. The concept of applying RSS/LSS to a sound pacifier product to soothe a crying baby.
31. The concept of applying RSS/LSS to sound animated animal attractant or repulsion products.
32. The concept of applying RSS/LSS to sound generation for games.
33. The concept of applying RSS/LSS to sound animated dolls and stuffed animals.
34. The concept of applying RSS/LSS to Sound Bloxx.
35. The concept of applying RSS/LSS to Live Action Sound Unit.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A method of generating a continuous random sequenced sound of arbitrary duration and having predetermined head and tail sound segments, the method comprising the steps:

providing a group of sound segments including a head segment, a plurality of compatible middle segments and a tail segment;

responsive to a play signal, selecting and playing the head segment;

then selecting from and playing the middle segments as long as the play signal persists; and responsive to a termination of the play signal, selecting and playing the tail segment, thereby providing a continuous sound having a duration coextensive with the play signal and beginning and ending with the head and tail sound segments, respectively.

2. A method according to claim 1 wherein said selecting from the middle sound segments includes randomly selecting from the middle sound segments according to a predetermined weighted probability.

3. A method according to claim 1 wherein:

the sound to be generated is a horn sound;

the head sound segment contains an opening sound of a horn;

the middle sound segments each contains a sustained horn sound;

the tail segment contains a closing sound of a horn; and the end of the tail segment is formed so as to be compatible with the beginnings of all of the middle segments, thereby ensuring a smooth transition into the middle segments.

* * * * *

UNITED STATES PATENT AND TRADEMARK OFFICE

CERTIFICATE OF CORRECTION

PATENT NO. : 5,633,985
DATED : May 27, 1997
INVENTOR(S) : Severson et al.

It is certified that error appears in the above-indentified patent and that said Letters Patent is hereby corrected as shown below:

Column 1, line 60, change "tile" to --the--;
Column 5, line 58, change "frown" to --from--;
Column 7, line 35, change "finger" to --ringer--
Column 13, line 37, change "frown" to --from--;
Column 13, line 41, change "frown" to --from--.

Signed and Sealed this

Twenty-fourth Day of February, 1998

*Attest:*

Bruce Lehman

BRUCE LEHMAN

*Attesting Officer*

*Commissioner of Patents and Trademarks*